United States Patent [19]

Müller

[11] 4,285,830

[45] Aug. 25, 1981

[54] METHOD AND APPARATUS FOR RECONDITIONING WASTE SOLUTIONS OF THE NUCLEAR INDUSTRY WHICH CONTAIN AMMONIUM NITRATE

[75] Inventor: Burkhardt Müller, Übach-Palenberg, Fed. Rep. of Germany

[73] Assignee: Kernforschungsanlage Jülich Gesellschaft mit beschränkter Haftung, Jülich, Fed. Rep. of Germany

[21] Appl. No.: 964,906

[22] Filed: Nov. 30, 1978

[30] Foreign Application Priority Data

Nov. 30, 1977 [DE] Fed. Rep. of Germany ..... 2753368
Nov. 11, 1978 [DE] Fed. Rep. of Germany ..... 2849050

[51] Int. Cl.[3] ..... G21F 9/14

[52] U.S. Cl. ..... 252/301.1 W; 159/DIG. 12; 422/159; 423/396; 423/400; 423/405

[58] Field of Search ..... 252/301.1 W; 422/159; 159/DIG. 12; 423/400, 405, 396

[56] References Cited

U.S. PATENT DOCUMENTS

| | | | |
|---|---|---|---|
| 2,968,719 | 1/1961 | Haberle et al. | 250/435 |
| 3,101,258 | 8/1963 | Johnson | 252/301.1 W |
| 3,191,662 | 6/1965 | Schneider | 252/301.1 W |
| 3,361,649 | 1/1968 | Karter | 252/301.1 W |
| 3,862,296 | 1/1975 | Dotson et al. | 252/301.1 W |
| 3,950,216 | 4/1976 | Burns | 159/DIG. 12 |

FOREIGN PATENT DOCUMENTS

| | | | |
|---|---|---|---|
| 1299610 | 7/1969 | Fed. Rep. of Germany | 423/400 |

*Primary Examiner*—Deborah L. Kyle
*Attorney, Agent, or Firm*—Becker & Becker, Inc.

[57] ABSTRACT

A method and apparatus for reconditioning waste solutions of the nuclear industry which contain ammonium nitrate. The waste solution is continuously sprayed from above into a 300° to 600° C. hot zone, from the lower end of which the decomposition products are withdrawn and are separated into condensate and exhaust gas. The NO content is reduced by adding oxygen, especially at the exit of the decomposition zone. By the presence of reducing agents, such as $CO(NH_2)_2$ or preferably $NH_3$, in the solution to be sprayed, the $NO_2$ content of the decomposition products and the $NH_4NO_3$ residue in the condensate can be practically eliminated and an additional precipitation in the condensate which can be filtered off can be obtained. Optimal contents are 0.25–0.4 Mol $NH_3$ and 0.15–0.25 Mol $CO(NH_2)_2$ per Mol $NH_4NO_3$. Prior to the thermal decomposition, the waste solution is preferably concentrated, cooled off, and filtered to about 60% or (if a solution containing reducing agents is to be sprayed) about 48% $NH_4NO_3$ at about 60° C. in a thin layer evaporator, and is temporarily stored at room temperature. The addition of ammonia to the concentrate offers a precipitation which can be filtered off.

12 Claims, 10 Drawing Figures

METHOD AND APPARATUS FOR RECONDITIONING WASTE SOLUTIONS OF THE NUCLEAR INDUSTRY WHICH CONTAIN AMMONIUM NITRATE

The present invention relates to a method of reconditioning waste solutions which contain ammonium nitrate and, as the case may be, urea produced during the manufacture of fuel and/or breeder material for nuclear reactors. According to this method, relatively small amounts of solution are continuously brought into an ammonium nitrate decomposition temperature zone. The decomposition products which are formed are separated by condensation into a fluid and a gaseous phase. The present invention also relates to an apparatus for carrying out this method.

During a number of methods for producing nuclear fuels, aqueous solutions containing ammonium nitrate are produced as byproducts. Thus, for example, after the precipitation of uranyl ammonium carbonate (hereafter referred to as UAC), an aqueous filtrate results which can still contain about 500 to 800 mg/l uranium as well as other radioactive materials such as plutonium, thorium, and members of the disintegration or Actinide series, as well as (from nuclear fuels used up during the processing) not completely separated off fission products. Furthermore, such solutions can contain considerable quantities of salts, such as 100 to 160 g/l $NO_3^{-1}$, 75 to 125 g/l $NH_4^{+1}$, as well as 50 to 80 g/l $CO_3^{-2}$.

Such waste solutions, on the one hand, due to their radioactivity, cannot be conveyed into the waste water or sewage system, and, on the other hand, can cause difficulties during reconditioning since ammonium nitrate in high concentration has a tendency toward strong exothermic decompositions to the point of explosions.

Jean-Claude Mora (Energie Nucleaire 14 (1972) pages 38–44) discloses a method developed particularly for the recovery of cesium-137 from waste solutions of the fuel preparation. According to this method, an approximately 10 to 46% ammonium nitrate solution as a thin liquid film flows down on the furnace wall, which is at the decomposition temperature and on which the cesium salt is deposited, while the decomposition gases which are formed are withdrawn from the head of the furnace and are separated in a subsequent condenser into a liquid and a gaseous phase.

With this method, on the one hand, difficulties arise regarding the uniform distribution of the film over the wall of the furnace, which wall must additionally be cooled at its upper portion, and on the other hand, narrow limits are set for the increase in throughput by the enlargement of the heating surface.

In this manner, no continuous operation can be maintained over longer periods of time, since the salt deposits must be dislodged from the furnace walls relatively often.

It is therefore an object of the present invention to provide a method for reconditioning waste solutions of the above mentioned general type containing ammonium nitrate, according to which the method can be performed continuously and danger-free, in which connection it is particularly desirable to optimize the accumulation of as little waste as possible and waste products which are as harmless as possible, with expedient resupply of valuable portions.

It is a further object of the present invention to provide an apparatus for reconditioning waste solutions of the above mentioned type.

These objects, and other objects and advantages of the present invention, will appear more clearly from the following specification in connection with the accompanying drawings, in which.

Figure 7:
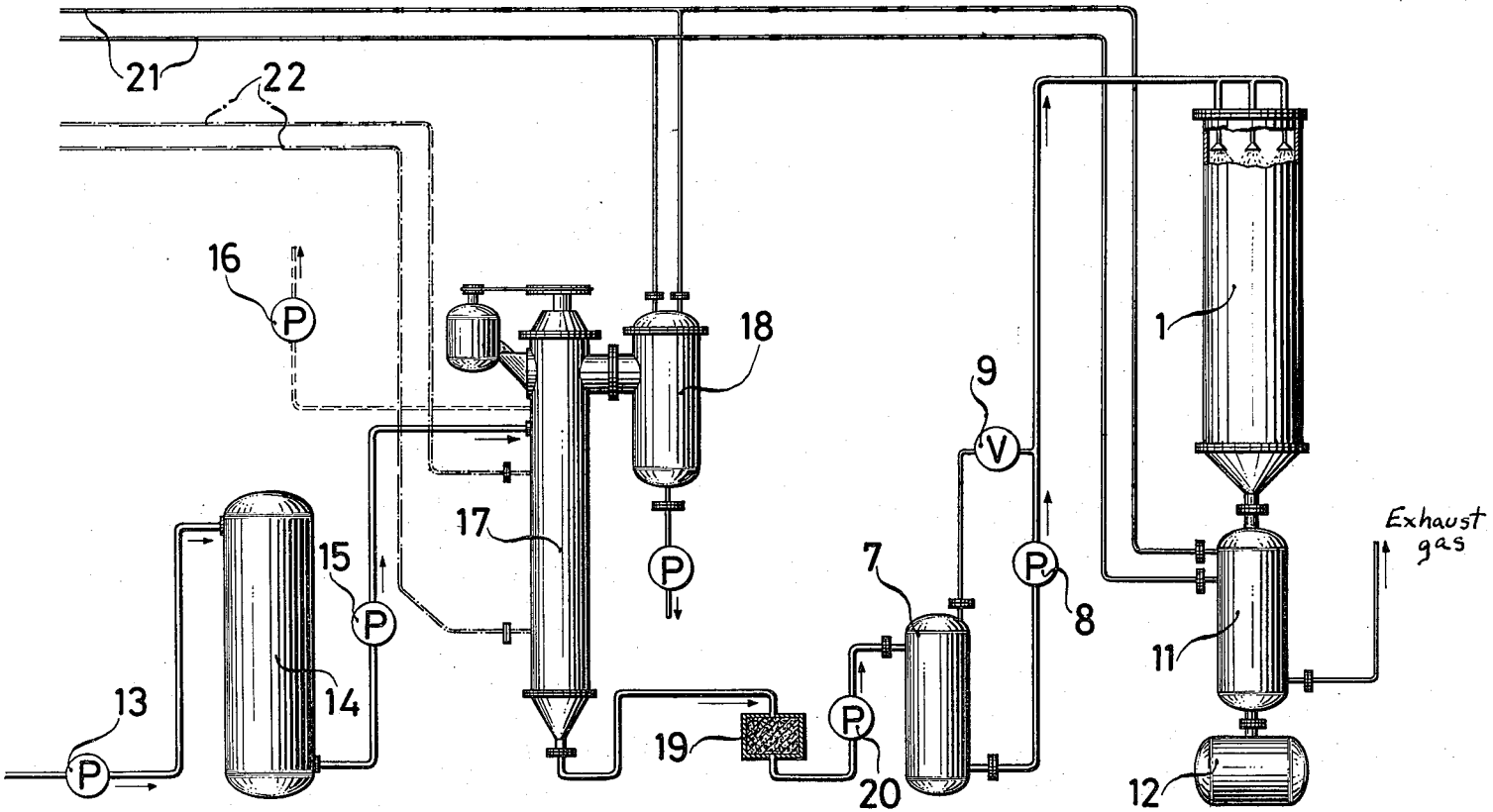
Figure 8:
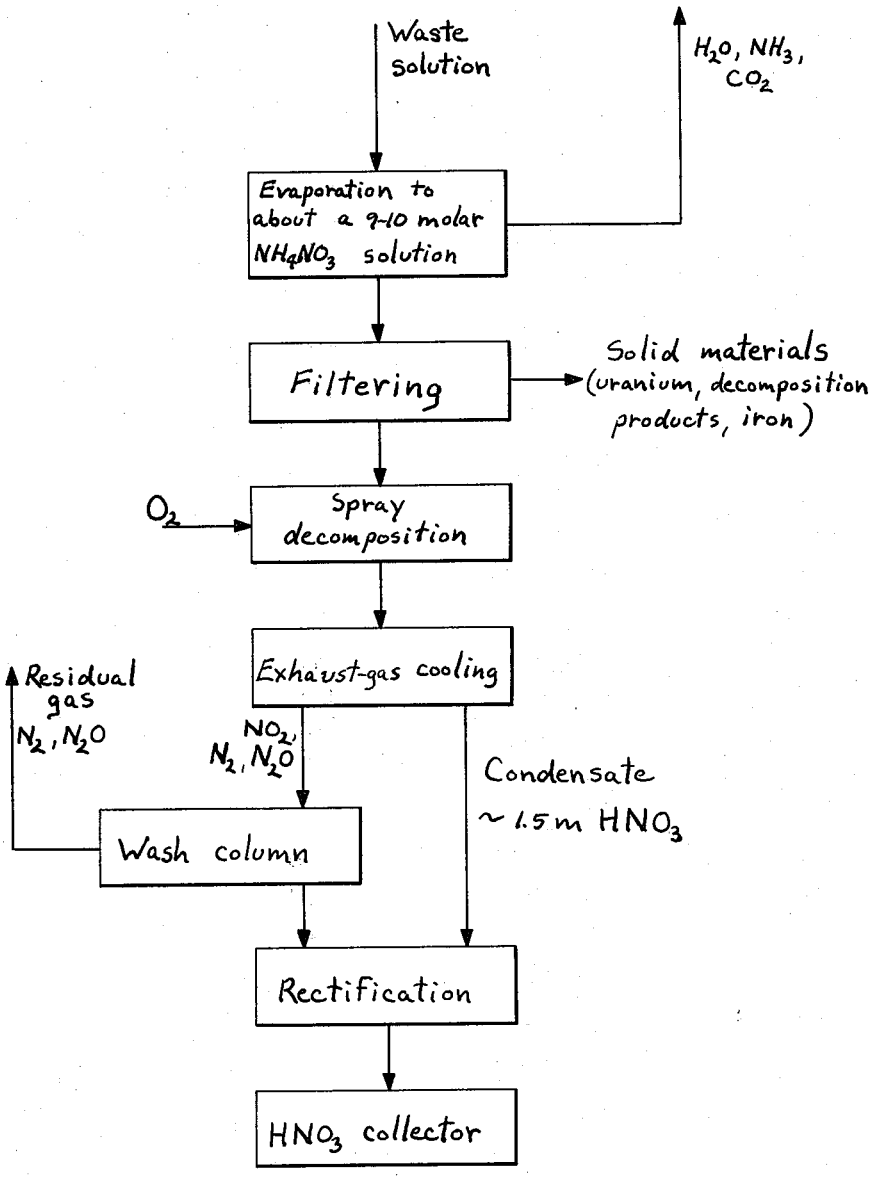
Figure 9:
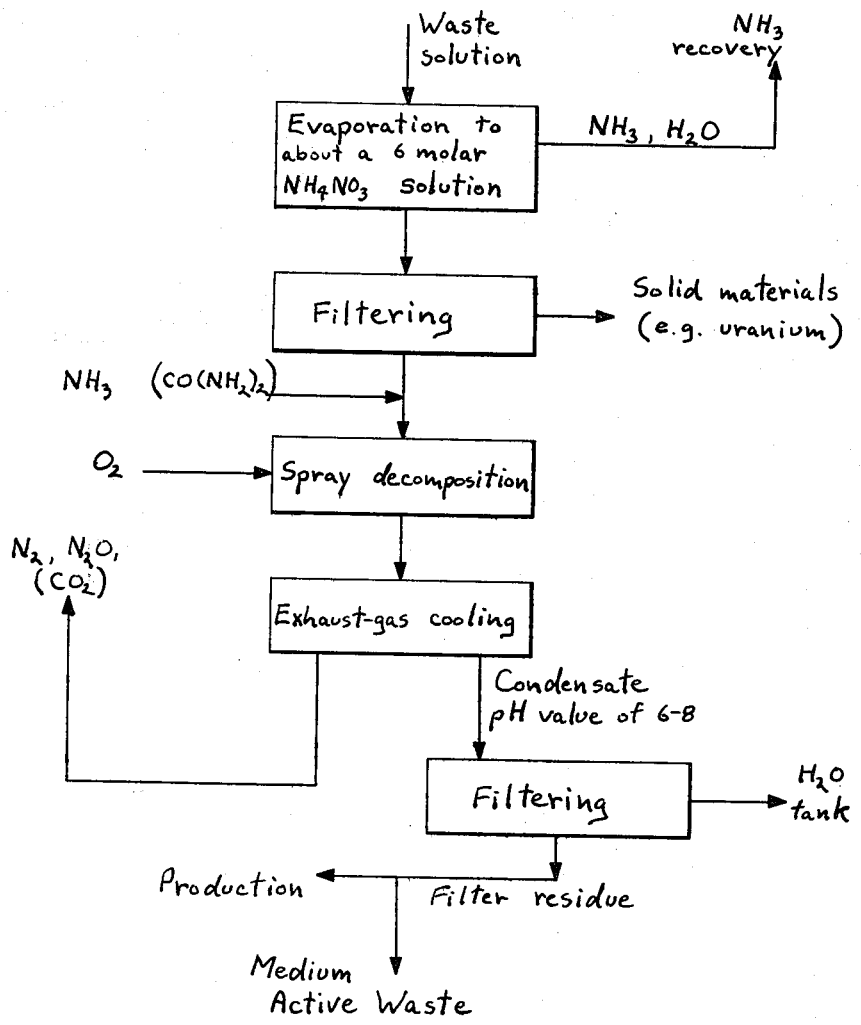
Figure 10:
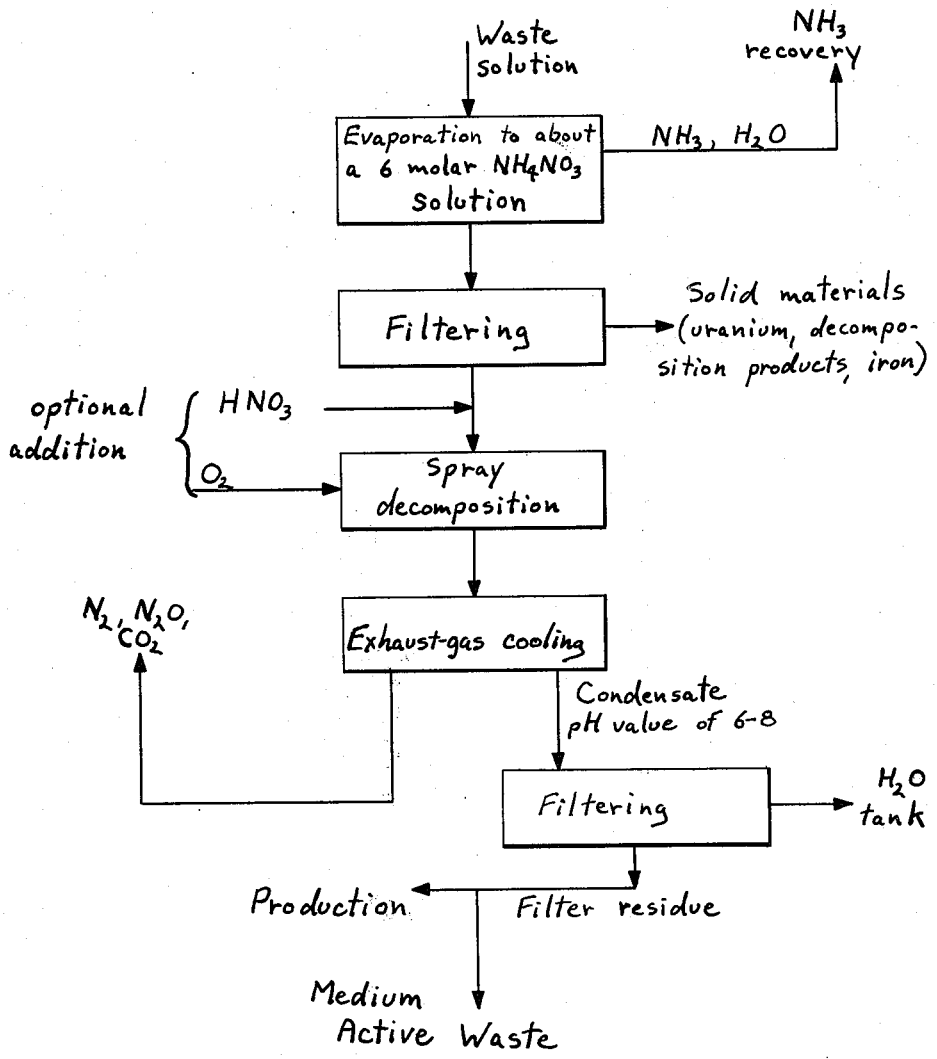

FIG. 7 shows an apparatus for reconditioning waste solution containing ammonium nitrate pursuant to the present invention; and FIGS. 8–10 are flow diagrams showing the thermal spray decomposition of $NH_4NO_3$ waste solutions with the addition of $NH_3$ or $CO(NH_2)_2$ (FIG. 9); nitric acid recovery with waste solutions which contain no reducing agent (FIG. 8); or starting from strong urea containing solutions (FIG. 10).

The method of the present invention is characterized primarily by a method of the above mentioned general type, in which the waste solution is sprayed into the decomposition temperature zone.

The method of the present invention not only prevents larger quantities of ammonium nitrate-containing waste from suffering, as the case may be, explosive decomposition, but also assures a relatively simple controllable continuous operation and makes it possible to apply the method to the decomposition of larger quantities of material, since the decomposition essentially takes place in the gas chamber and the resulting reaction mixture is continuously conveyed away from the region of the furnace. On the furnace walls, which are naturally hotter than the inner space, there results a gas movement away from the wall of the furnace. This gas movement retards an extensive accumulation of material on the furnace wall.

The droplets, which are different sizes due to their original formation or due to subsequent reuniting, fall down within the furnace at different rates, so that the decomposition of the solid products is delayed over a considerable furnace length. In this connection, the decomposition of the solid material derived from smaller droplets is accompanied by a water release of still larger droplets. As a result, critical conditions are additionally avoided.

It is especially desirable that the waste solution be sprayed into the decomposition furnace from above, while the decomposition products be carried off from the lower end of the furnace, so that during some interruption in operation no decomposable products can accumulate in the lower region of the furnace.

The inventive improvement with regard to preventing critical conditions offers the possibility of processing relatively concentrated solutions, where critical ranges are also to be avoided. Thus, for example, a waste solution which has been concentrated to such an extent that it contains about 60% ammonium nitrate or (in the additional presence of ammonia or urea) about 48% ammonium nitrate is sprayed into the decomposition-temperature region. The temperatures of this region are in the range of 300°-600° C., preferably 350°-450° C.

Especially after the furnace has been operated for a long time (for example at the end of the work week or once a month), when an incrustation is discovered on the hot furnace surfaces, this incrustation can be dissolved by spraying in nitric acid. The addition of nitric acid prior to the spray decomposition can be additionally expedient if the waste solution contains larger quantities of urea, which can give rise to the separating out of ammonium carbonate in the decomposition gas or in the waste gas.

In addition to single material spray nozzles, binary material nozzles can also be used, which can then spray in along with the salt solutions, for example, hot air for better atomization. In so doing, the oxygen contained in the air can reduce or completely eliminate the NO content of the decomposition gas. For eliminating NO, a quantity of oxygen equivalent to the NO content of the decomposition gases can also be added to the hot decomposition products prior to or after their exit from the decomposition zone.

Pursuant to a particular feature of the present invention, the content of reducing agents such as ammonia or urea in the solution to be sprayed should be kept within certain limits.

Referring now to the drawings in detail, the graphs of FIGS. 1 through 5 show the effect of the $NH_3$ content of the spray solution on the decomposition products. If $NH_3$ is added to the solution which is to be sprayed, there results chiefly a decline of the nitric acid concentration in the condensate (FIG. 2) and of the $NO_2$ portion in the waste gas (FIG. 3), which achieves an optimum with an $NH_3$ portion of about 0.3 Mol $NH_3$ per Mol $NH_4NO_3$ (the nitric acid or ammonia content in the condensate becomes negligible and the $NO_2$ concentration in the waste gas drops from 20% to about 1%, in which connection the residue of undecomposed $NH_4NO_3$ in the condensate (FIG. 1) is reduced to about 1%, even if the heating element temperatures are not optimally selected).

Figure 1:
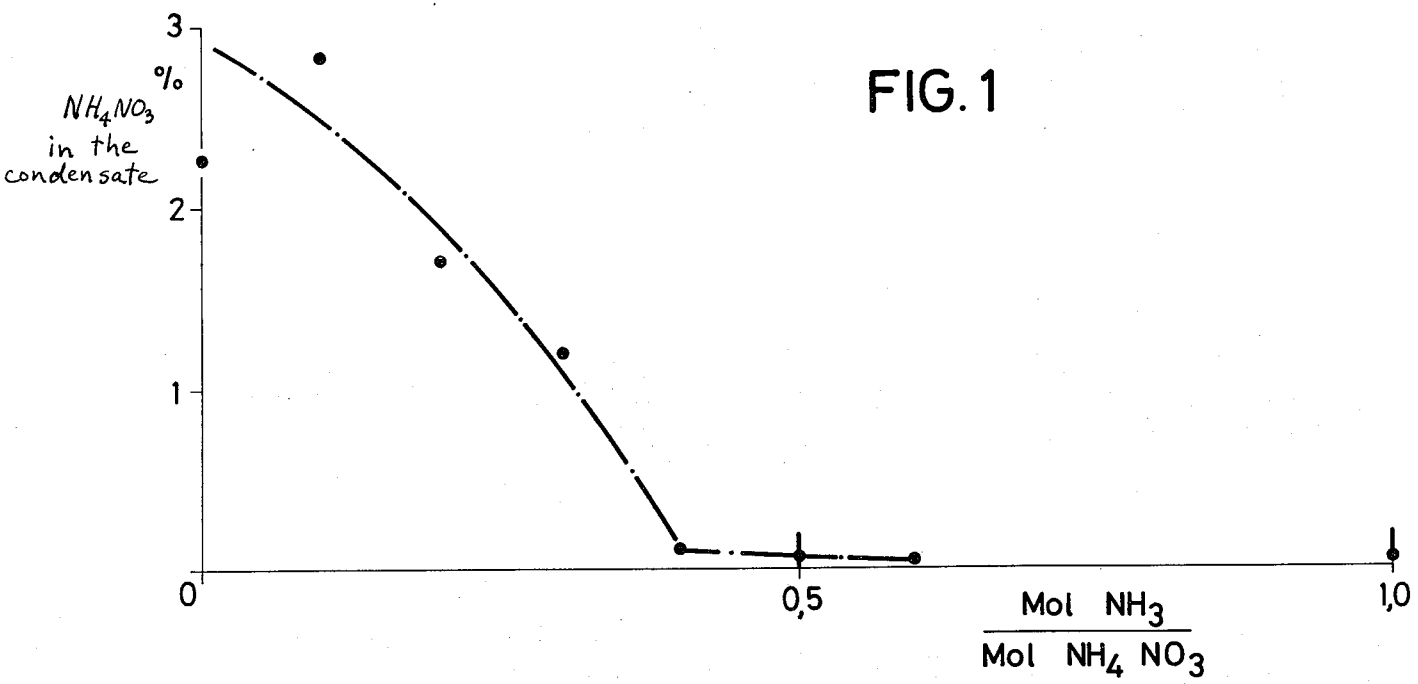
FIG. 1 shows the $NH_4NO_3$ residue in the condensate.
Figure 2:
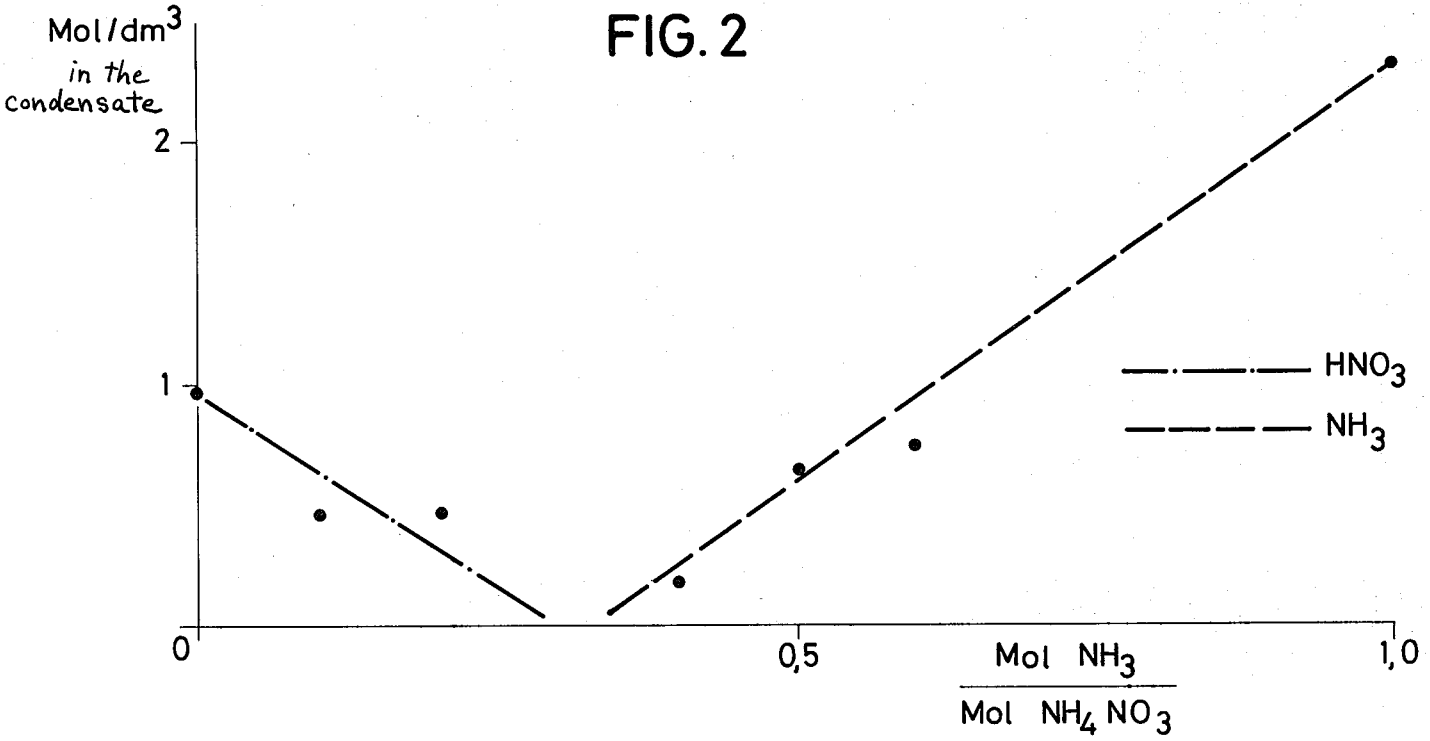
FIG. 2 shows the $HNO_3$ or the $NH_3$ content of the condensate.
Figure 3:
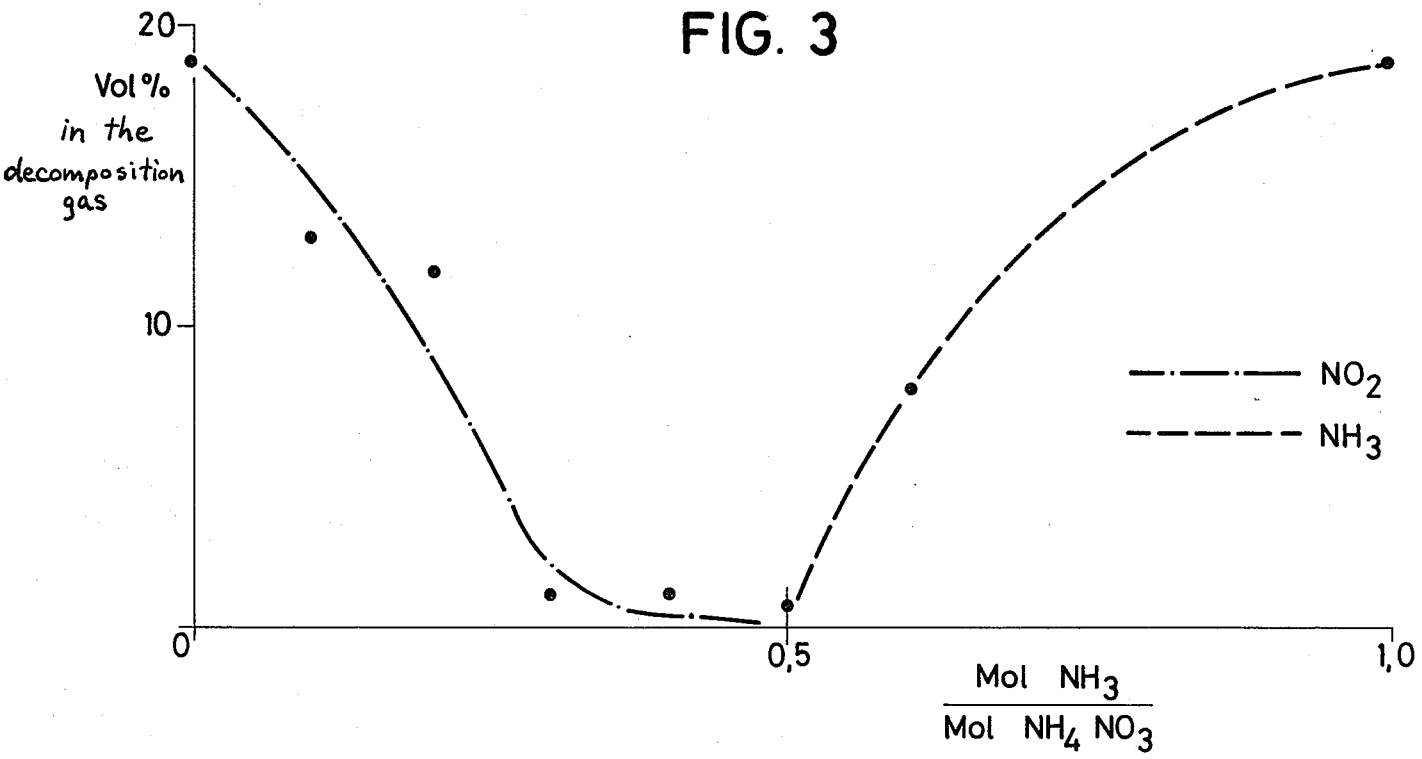
FIG. 3 shows the $NO_2$ or the $NH_3$ content in the decomposition gas.
Figure 4:
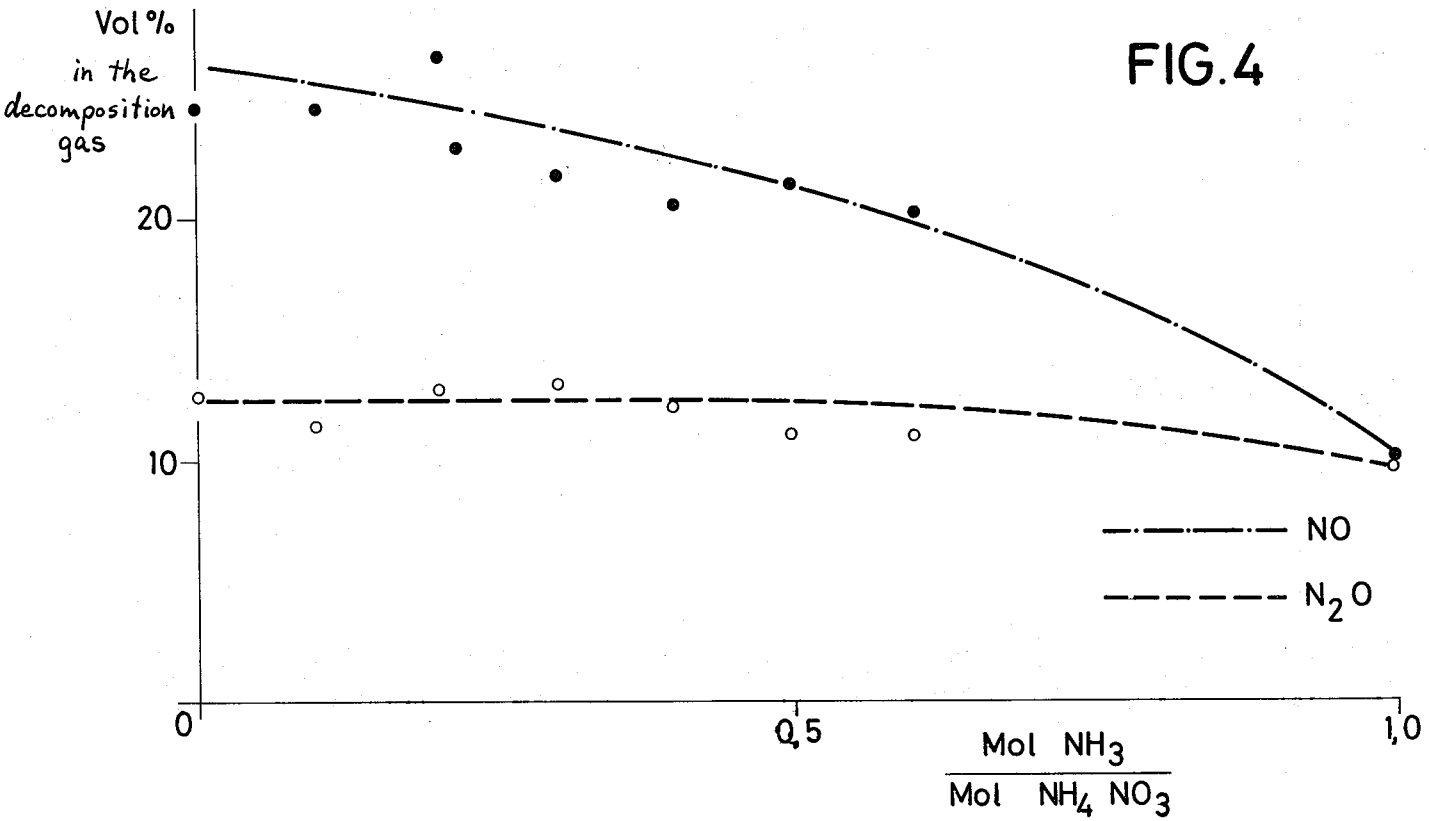
FIG. 4 shows the NO and the $N_2O$ content in the decomposition gas.
Figure 5:
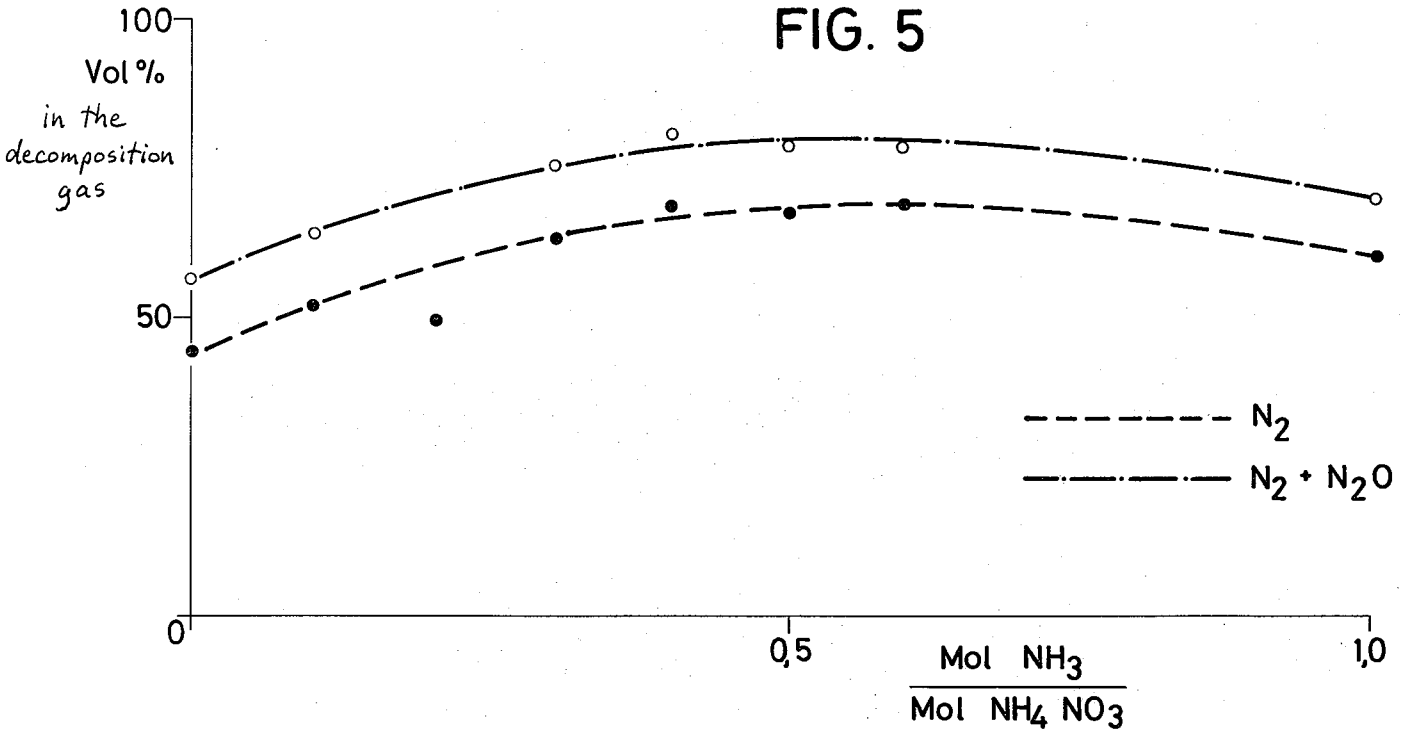
FIG. 5 shows the $N_2$ and the $N_2+N_2O$ content in the decomposition gas.

As shown in FIGS. 1-3, if the $NH_3$ addition is increased over the above mentioned value of 0.3Mol per Mol $NH_4NO_3$, then ammonia appears in the condensate, although the ammonium nitrate content in the condensate and the $NO_2$ content in the waste gas drop still further, By adding ammonia to the solution which is to be sprayed, a further uranium containing precipitation is obtained in this solution. This precipitation, which can be filtered off, reduces the uranium content in the spray solution by a power of about 10. In addition, the nature of the condensate is clearly a function of the ammonia content of the solution to be sprayed. With an ammonia-containing solution, one obtains a condensate having precipitation products which can be filtered off and supplied for production or final storage. In this manner, the residual activity of the remaining liquid is further reduced.

Results similar to those obtained with ammonia are obtained with a spray solution having a corresponding urea content (in this connection, however, in comparison to ammonia, Mol-concentrations reduced by a factor of ½ are required).

With regard to the results, it appears expedient that the solution which is to be decomposed have an ammonia content of 0.2 to 0.6, especially 0.25 to 0.4 Mol per Mol ammonium nitrate, or correspondingly, a free urea content of 0.1 to 0.5, especially 0.15 to 0.25 Mol per Mol ammonium nitrate. This ammonia or urea content can be adjusted by addition of these reducing agents or also by a corresponding reduction, especially of the urea content of the starting solution by means of nitric acid, if the starting solution is rich in urea (an $NH_3$ excess disappears during concentration of the solution).

In comparison, the condensate which collects in the condenser during the decomposition of ammonium nitrate solutions without the addition of reduction agents has a 1 to 1.5 molar nitric acid concentration. The residual uranium found in this condensate exists in the dissolved state and need not be separated off, since the nitric acid solution—as the case may be after concentration by distillation—can then be inserted in the area of the uranium processing.

The residual liquids, which result during the different methods, can, according to activity and "unusability", also be resupplied to the waste solution reconditioning in the cycle to the concentration step, until a sufficient activity accumulation justifies a delivery to final storage with solidification or the like.

As already mentioned above, the solution to be sprayed should preferably have an ammonium nitrate concentration of about 60% (or about 48% with an additional ammonia or urea content of the spray solution). These concentrations can be viewed as optimal with regard to a preconcentration with a simultaneously still endothermic overall system. The waste solutions, which arrive for reconditioning and which normally have a low $NH_4NO_3$ concentration, should first be concentrated, for which purpose a thin layer evaporator is particularly suitable. In this evaporator, by an adequate underpressure, an evaporation temperature below 100° C., especially about 60° C., is provided.

In this type of evaporator, not only the excess water but also ammonia and other volatile materials such as carbon dioxide, which are present in the waste solutions of the individual manufacturing methods, are vaporized. At the same time, the by far greatest portion of the residual UAC precipitates as a fine product. This precipitation product can be filtered off, in the course of which a uranium depletion of the waste solution is achieved. Thus, the concentrate obtained after filtering off the precipitation product formed during concentration has a uranium content which is reduced by a factor of about 50. In contrast, if the solution is concentrated at normal pressure and at temperatures over 100° C., a conversion of the uranyl salt results which then remains largely in the solution. By means of the relatively rapid evaporation at low temperatures, this disadvantageous effect is avoided.

The ammonia and carbon dioxide which escape with the exhaust gas can lead to clogging or blocking on the pressure side of the vacuum pump by recombining. For this reason, water jet or liquid seal pumps are expedient.

The filtered concentrate is temporarily stored as stock solution for the spray process in receptacles which are kept at about room temperature and, as the case may be, are cooled for this purpose. In this connection, a, as the case may be, too high salt concentration is lowered to the desired value by crystallization. This applied especially for the 60% concentrate, while solutions which contain reduction agents, the concentration of which in regard to a still endothermic overall condition should be selected at 48% $NH_4NO_3$, require monitoring of the concentration in the intermediate receptacle. In this way, as the case may be, an unintentionally achieved too high a salt concentration in the spray solution is avoided and thus the operating risk of the spray decomposition is reduced (with salt portions of more than 76% by weight, the overall reaction during decomposition of $NH_4NO_3$ solutions becomes exothermic.

Figure 6:
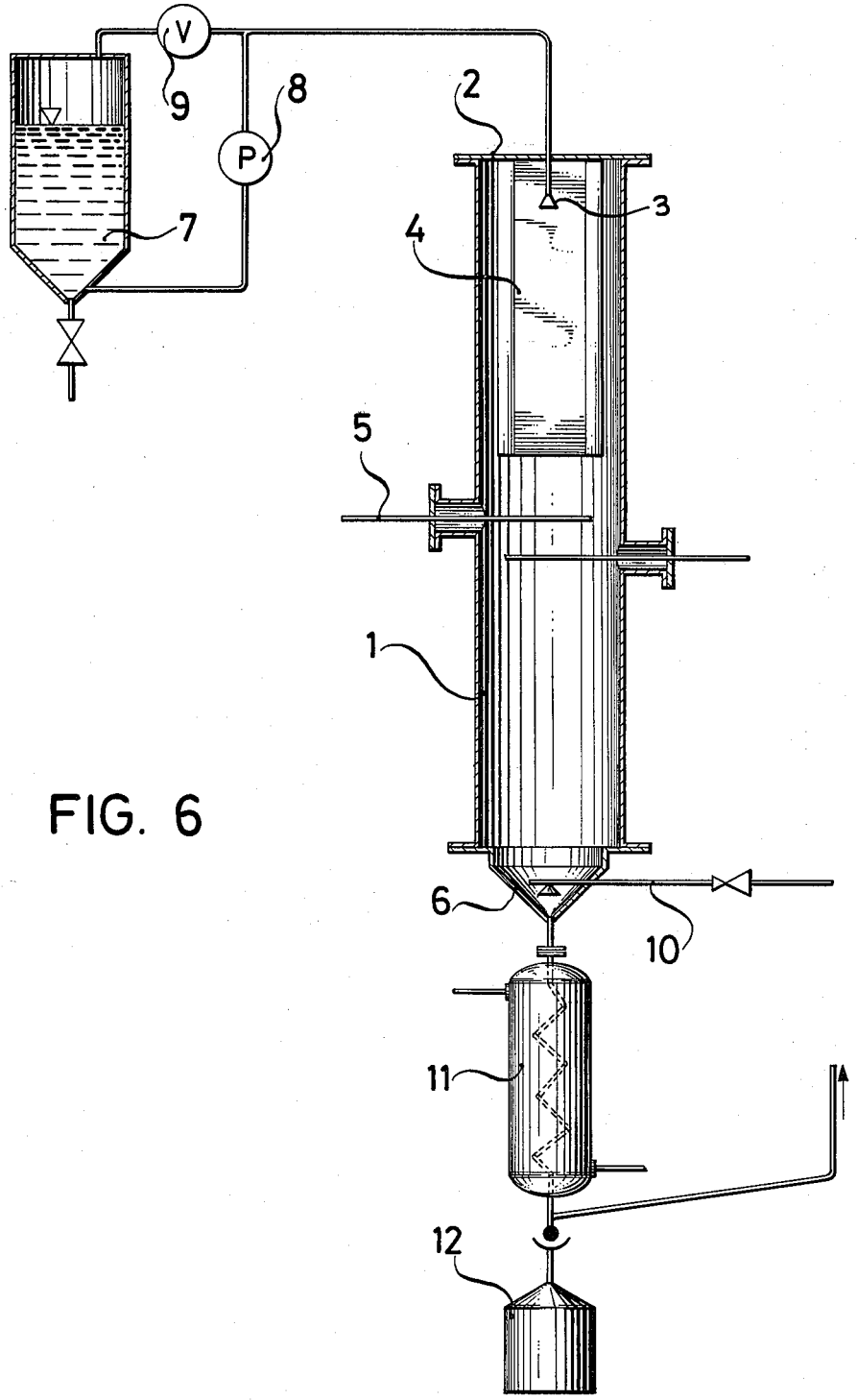
FIG. 6 shows an apparatus for spray decomposition having a supply line and a condenser.

Referring now to FIG. 6, the temporarily stored concentrate passes from the supply receptacle into the spray decomposition furnace, which can essentially comprise a tube 1 which is electrically heated from the outside and is made of temperature and acid resistant steel and has a cover 2 which, as the case may be, is likewise heated. The furnace further comprises spray nozzles 3 and heating elements 4 and 5 located at the upper end and in the middle respectively. A funnel-shaped gas outlet 6 is located at the lower end of the furnace.

Concentrated aqueous salt solution is pumped from the supply receptacle 7 by the fluid pump 8 through the pressure relief valve 9, provided for safety reasons, and is pumped under pressure to the nozzle or nozzles 3, where the salt solution is finely sprayed in. By using 0.3 mm nozzles, the average size of the droplets was 10–20 μm, and the maximum droplet size was about 40–60 μm.

The decomposition products formed in the furnace are conveyed off through the funnel 6. In this connection, in order to convert No to $NO_2$, oxygen or air in the necessary proportion is supplied through the connecting line 10. The decomposition products are cooled off in the cooler 11 in such a way that the water vapor which is contained therein, accompanied by further soluble or non-volatile components, is condensed and flows into the condensate receptacle 12. The residual gas, which, in accordance with the method used, comprises mainly still residual $NO_2$, $N_2$, NO, and $N_2O$, can be conveyed to customary apparatus for purification of exhaust gas along with recovery of nitric acid.

With one laboratory prototype, the length of the tube 1 was about 2.0 m, and the diameter was about 0.3 m. The spray nozzle 3 extended from the cover 2 about 100 mm into the decomposition chamber and sprayed (at about five l/h) the concentrate under pressure (about 20 bar) to a fine mist. In addition to the nozzle, tube-like heating elements were mounted on the cover in such a way that they projected deeply into the cylindrical decomposition chamber and transferred the heat as well as possible to the mist and gas. In addition, the cover and cylinder wall were electrically heated in such a way that heat was supplied to the sprayed-in salt concentrate from all sides. The maximum overpressure in the decomposition furnace was 10 mbar. This overpressure was produced by the accumulation of the escaping gases.

FIG. 7 shows one model of an apparatus for reconditioning ammonium nitrate-containing waste solutions and having a spray decomposition furnace or tube 1 of the type shown in FIG. 6. This apparatus is the basis for treating waste solutions from the production of nuclear fuel according to the "UAC" method. The solution coming from a filter of the UAC production is conveyed by the pump 13 into the intermediate receptacle 14. From there, the solution is conveyed by a further pump 15 into the thin layer evaporator 17 which operates together with a vacuum pump 16. The vapor from the evaporator 17 is condensed in the unit 18.

The concentrate leaving the thin layer evaporator 17 is conveyed through the filter 19 and, by means of a pump 20, into the supply receptacle 7 which, by means of a cooler which is not shown, is kept at about room temperature. By means of a further pump 8, the supply or stock solution is forced out of the receptacle 7 to the spray nozzles at the upper end of the spray decomposition furnace 1. The (non-volatile) reaction products of the solution are condensed in the unit 11 and are collected in the condensate collector 12. FIG. 7 also shows cooling water lines 21 for the condensers 18 and 11, as well as a vapor line 22 to and from the thin layer evaporator 17.

The flow diagrams of FIGS. 8–10 show different variations of the method of the present invention and have in general been discussed in the specification. Therefore, and since they are quite easy to follow and to understand, these flow diagrams will not be discussed in detail.

The present invention is, of course, in no way limited to the disclosure of the drawings, but also encompasses any modifications within the scope of the appended claims.

What I claim is:

1. A method of treating waste solutions which are produced during the production of fuel and breeder material for nuclear reactors and which contain about 60 weight percent ammonium nitrate which method comprises the steps of:

continuously spraying waste solution containing about 60% ammonium nitrate into an ammonium nitrate decomposition furnace for essential decomposition; and subjecting the decomposition products formed during said spraying step to condensation to enable separation of said decompositions products into a liquid and a gaseous phase; and supplying a quantity of oxygen, equivalent to the NO content of the decomposition products, to the ammonium nitrate decomposition zone.

2. A method according to claim 1, in which said decomposition furnace is vertically oriented, said waste solution is sprayed from above, into said furnace, and said decomposition products are removed through an exit in a lower region of said furnace.

3. A method according to claim 2, in which said oxygen is added at the exit of the decomposition furnace.

4. A method according to claim 1, in which the decomposition furnace operates at temperatures ranging from 300° to 600° C.

5. A method according to claim 4, in which the decomposition furnace operates at temperatures ranging from 350° to 450° C.

6. A method according to claim 1, which includes the step of adding 0.2 to 0.6 mole of ammonia per mole of ammonium nitrate or 0.1 to 0.5 mole of urea per mole of ammonium nitrate prior to said spraying step.

7. A method according to claim 1, which includes the steps of distilling off water from the liquid condensate phase of the condensed decomposition products, and selectively supplying the remainder of said condensate for fuel production and to said waste solution which is to be sprayed.

8. A method according to claim 1, which includes the step of concentrating said waste solution prior to said spraying step at temperatures below 100° C.

9. A method according to claim 12, in which said concentration step takes place at about 60° C.

10. A method according to claim 8, which includes the step of concentrating said waste solution in a thin layer evaporator prior to said spraying step.

11. A method according to claim 8, which includes the steps of concentrating and then filtering said waste solution prior to said spraying step.

12. A method according to claim 8, which includes the steps of concentrating said waste solution and then storing it at room temperature prior to said spraying step.

* * * * *